United States Patent [19]

Moore et al.

[11] Patent Number: 5,058,772

[45] Date of Patent: Oct. 22, 1991

[54] DISPENSER CLOSURE WITH DRAIN BACK FEATURE

[75] Inventors: David N. Moore, Plainfield; Richard J. Petro, Mokena; Jeffrey F. Ullrich, Western Springs, all of Ill.

[73] Assignee: Phoenix Closures, Inc., Naperville, Ill.

[21] Appl. No.: 435,030

[22] Filed: Nov. 13, 1989

[51] Int. Cl.[5] ..... B67D 1/16

[52] U.S. Cl. ..... 222/109; 222/571

[58] Field of Search ..... 222/108, 109, 551, 571, 222/147, 545; 215/202, 216, 218; 53/367

[56] References Cited

U.S. PATENT DOCUMENTS

| | | | |
|---|---|---|---|
| 2,601,039 | 6/1952 | Livingstone | 222/109 |
| 4,460,101 | 7/1984 | Tseng . | |
| 4,550,862 | 11/1985 | Barker et al. | 222/109 |
| 4,671,421 | 6/1987 | Reiber | 222/571 X |
| 4,697,722 | 10/1987 | Saito et al. . | |
| 4,863,067 | 9/1989 | Krall | 222/571 X |
| 4,890,770 | 1/1990 | Haga et al. | 222/571 X |

FOREIGN PATENT DOCUMENTS

| | | | |
|---|---|---|---|
| 0082439 | 6/1983 | European Pat. Off. . | |
| 0109704 | 5/1984 | European Pat. Off. . | |
| 0286843 | 10/1988 | European Pat. Off. . | |
| 348102 | 12/1989 | European Pat. Off. | 222/109 |
| 1013353 | 12/1965 | United Kingdom . | |

*Primary Examiner*—Michael S. Huppert
*Assistant Examiner*—Gregory L. Huson
*Attorney, Agent, or Firm*—Welsh & Katz, Ltd.

[57] ABSTRACT

A dispenser closure for attachment to the threaded neck of a container includes spout portion having an annular wall, a shoulder and a depending skirt, the skirt being threaded on an interior surface to lockingly engage the container neck, a spout formation disposed with an area defined by the annular wall and being integral with the spout portion, and a closed-top cap portion having a radially projecting annular shoulder with a depending collar, the collar being threaded on an interior surface to engage a threaded exterior surface of the upper end of the spout portion. A drainage opening in the spout portion facilitates the drainage of the entire contents of the container, and leveling formations facilitate automated assembly of the closure upon the container. Provisions are also disclosed for preventing the exposure of threaded areas of the closure to container contents.

20 Claims, 3 Drawing Sheets

DISPENSER CLOSURE WITH DRAIN BACK FEATURE

BACKGROUND OF THE INVENTION

The present invention relates to closures for containers designed to dispense the contents of the container by pouring, and specifically relates to a spouted closure which is securely attached to the container, which is easier to assemble and which is more efficient in its dispensing of the container contents.

Conventional dispenser closures used for pouring the container contents often consist of three components, an inner sleeve which is friction-fit to the inside of the neck of the container, a spout portion which is normally snap-fit into the sleeve so that the spout projects vertically beyond the upper margins of the sleeve and the container neck, and a cap portion which is threaded onto the neck and may often serve as a measuring cup. This type of closure is commonly used for containers of liquid household laundry detergent and related products, although the closure of the invention is not restricted to any specific type of application.

One disadvantage of conventional dispenser closures of the type described above is that the provision of a separate spout and sleeve requires additional tooling for its manufacture and additional labor for the assembly of the final cap. This results in a closure which is often more costly than desired for disposable containers.

Another disadvantage of conventional dispenser closures is that upon completion of pouring a portion of the contents into a measuring cup, the container is returned to an upright position. While most conventional closures have some provision for the drainage of excess contents of the container back into the container, it is very common for excess liquid to be retained on the exterior of the neck, and/or in the interior of the cap, creating a slippery and/or messy condition and making the container unpleasant to use. Also, when the container is almost empty, the design of the inner sleeve often prevents the emptying of the entire contents of the container, thus perpetually trapping a residual amount of the contents in the container. This creates a frustrating situation for the user and results in an unnecessary waste of contents.

Thus, there is a need for a container closure which is preassembled so that additional labor is not required for assembling the spout portion into the sleeve, which is designed to be securely fixed to the neck of the container, and which has sufficient draining capabilities so that excess material is not retained on the spout and on the cap, but instead is drained back into the container. Furthermore, there is a need for such a closure which facilitates the dispensation of the entire contents of the container.

SUMMARY OF THE INVENTION

Accordingly, the dispenser closure of the invention provides a two-piece closure including a preassembled spout portion which is threaded onto the container neck and is configured for locking engagement therewith. The spout portion has provisions for the drainage of any excess material back into the container. A cap portion includes a depending collar with shielded threads to prevent their exposure to by the contents of the container during pouring when the cap is used as a measuring cup.

More specifically, the present dispenser closure includes a generally cylindrical spout portion having an annular wall provided with a lower end, a central part and an upper end, the central part having a radially projecting peripheral shoulder with a depending skirt, the skirt being threaded on an interior surface for engagement with the exterior threads on the neck of the container. The upper end of the wall is threaded on an exterior surface. The spout portion also has an integral, lipped spout formation disposed within the interior of the annular wall. The annular wall has a drainage opening preferably linearly aligned with the lip of the spout and being in communication with the spout to facilitate the drainage of any residual material from the container out the end of the spout. The skirt may also be provided with ratchet teeth for engagement with locking formations on the container neck to ensure the secure attachment of the spout portion to the container. A cap portion includes a generally tubular wall with a lower end having a radially projecting annular shoulder with a depending collar, the collar being threaded on an interior surface to engage the threaded exterior surface of the upper end of the wall. The cap portion preferably has a portion of the lower end of the tubular wall depending past the lower edge of the collar to protect the threads of the collar from exposure to the container contents. The spout portion may also be provided with leveling legs to maintain the spout portion in a vertical orientation on a substrate for facilitated handling by automated machinery.

DESCRIPTION OF THE PREFERRED EMBODIMENT

Figure 1:
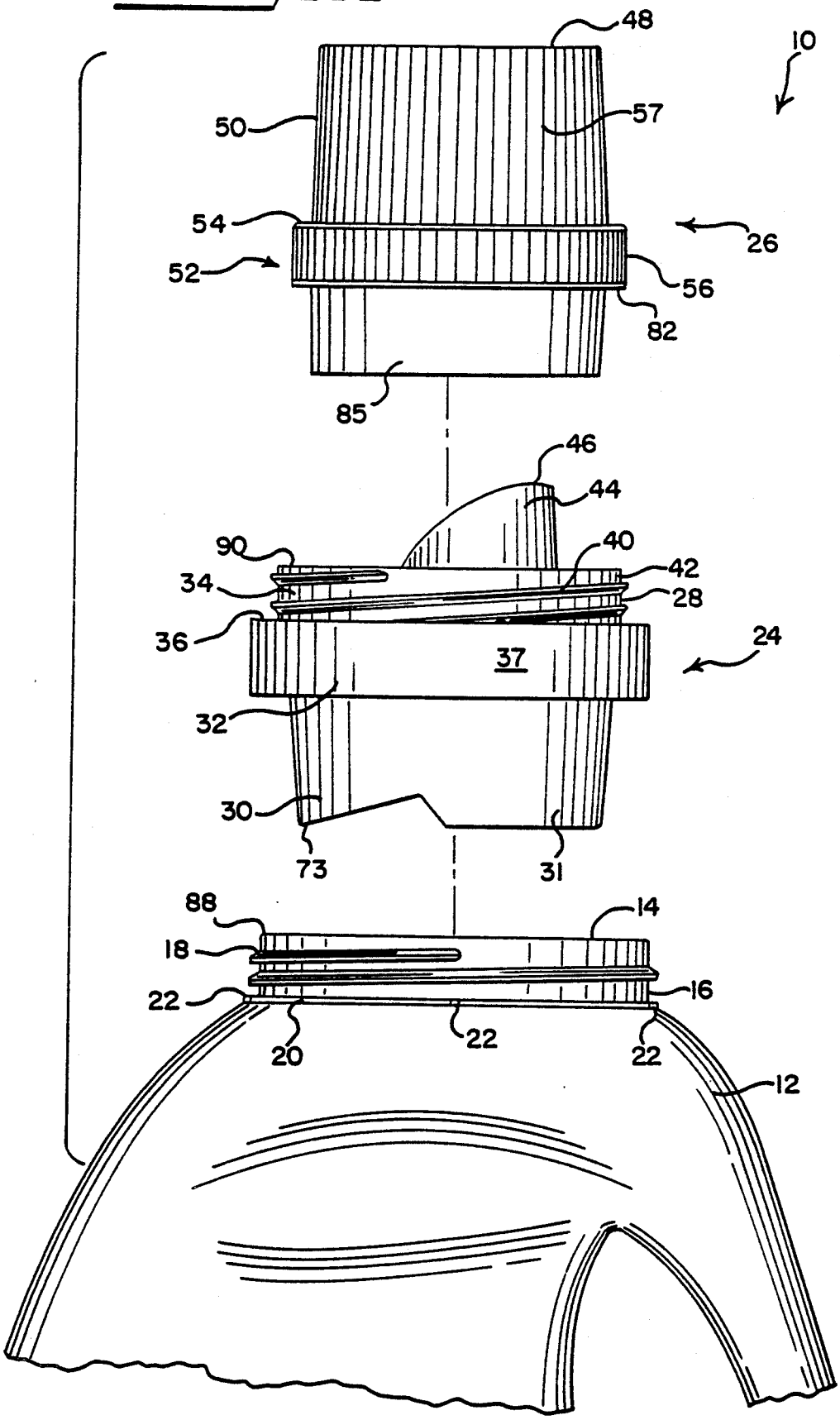
FIG. 1 is an exploded side elevational view of the closure of the invention and a corresponding container.

Referring now to FIG. 1, the closure of the invention is generally designated 10 and is shown exploded from a container 12. The container 12 includes a mouth 14 and a neck 16 having threads 18 on an exterior surface thereof. A radially projecting peripheral shoulder 20 is located at the base of the neck 16 and may be preferably provided with a plurality of locking formations 22. The container 12 may be manufactured of a suitable polymeric material, the specific material depending on the substance to be filled into the container 12.

Figure 4:
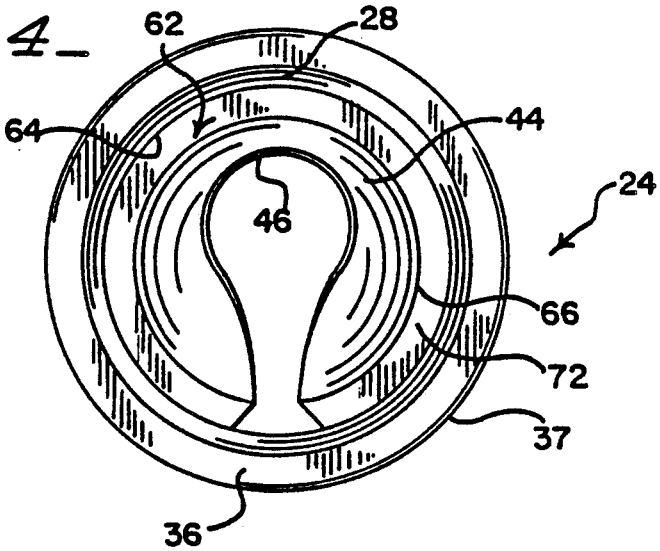
FIG. 4 is an overhead plan view of the spout portion shown in FIG. 3.
Figure 5:
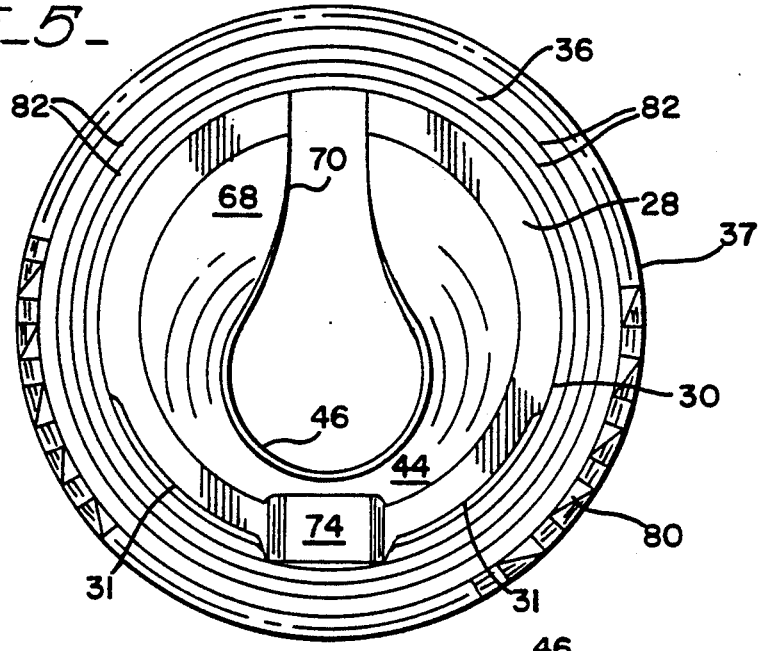
FIG. 5 is a bottom plan view of the spout portion shown in FIG. 3.
Figure 6:
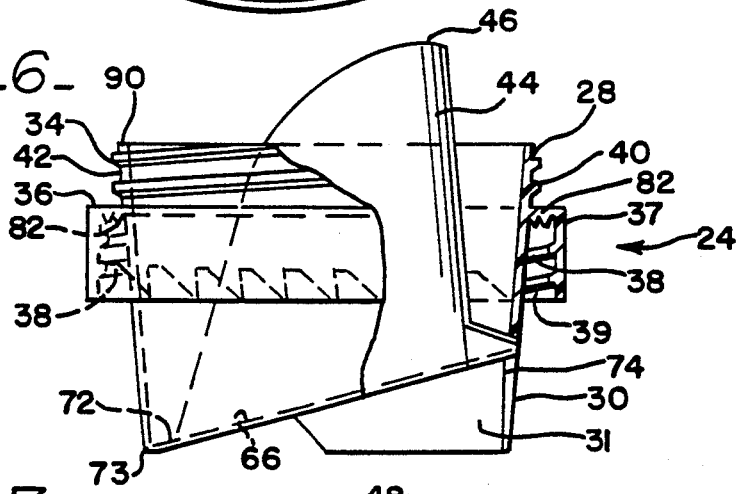
FIG. 6 is a vertical sectional view of the spout portion shown in FIG. 3 with portions broken away for clarity.

The closure 10 includes a spout portion 24 and a cap portion 26. The spout portion 24 and the cap portion 26 may be made of a suitable polymeric material. The spout portion 24 has an annular wall 28 with a lower end 30, a central part 32 and an upper end 34. The lower end 30 is dimensioned to be inserted into the mouth !4 and may be provided with at least one, and preferably two, leveling legs 31. A radially projecting peripheral shoulder 36 is located at the central part 32 and is provided with a depending skirt 37. The skirt is provided with threads 38 on an interior surface 39 (best seen in FIG. 6). The skirt 39 is configured to threadably engage the threaded container neck 16, and the threads 18, 38 are arranged so that when the spout portion is secured on the neck, the lip 46 will face a front end of the container 12 for effective pouring. The upper end 34 of the wall 28 is provided with threads 40 on an external surface 42. A spout formation 44 having a lip 46 is disposed within an area defined by the annular wall 28. The spout formation 46 is integral with the spout portion 24 (best seen in FIG. 4) and is preferably molded with the spout portion as a single piece.

The cap portion 26 includes a closed top 48, a generally tubular wall 50 depending from the top and having a lower end 52, the lower end being provided with a radially projecting annular shoulder 54 having a depending collar 56. In the preferred embodiment, the tubular wall 50 has a plurality of spaced, generally parallel, external gripping ribs 57. The collar 56 is provided with threads 58 on an interior surface 60 (best seen in FIG. 7). The threaded interior surface 60 is configured to threadably engage the exterior surface 42 of the wall 28.

Figure 2:
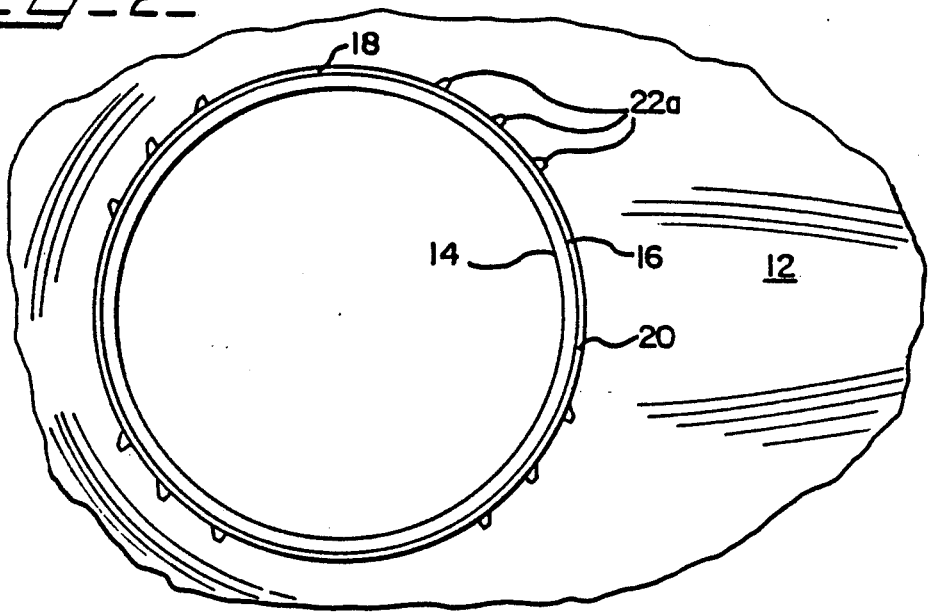
FIG. 2 is an overhead plan view of an alternate embodiment of the neck of the container shown in FIG. 1.
Figure 3:
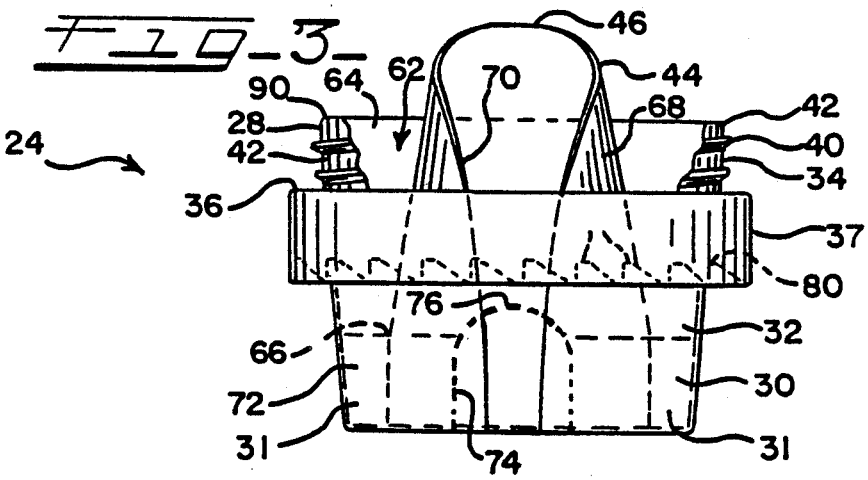
FIG. 3 is an elevational view of the rear of the spout portion of the closure shown in FIG. 1 with portions broken away for clarity.

Referring now to FIG. 2, an alternate embodiment of the container neck 16 is depicted in which a plurality of toothshaped formations 22*a* are shown provided in four groups of three. However, the use of any number of shapes and/or disposition of locking formations is contemplated.

Referring now to FIGS. 3 through 6, the spout portion 24 is shown in greater detail. The annular wall 28 defines an interior portion 62 having an inner surface 64. The spout formation 44 is disposed within the inner portion 62 and is generally frusto-conical in shape. The lip 46 is located at an upper end of the formation 44, which then gradually curves downwardly to a base 66. One side 68 of the formation 44 is generally open along a vertical line between the lip 46 and the base 66 and defines a slot 70.

The base 66 of the formation 44 is inclined and configured so as to be integral with a floor 72 of the spout portion 24. The floor 72 is inclined to enable the drainage of any excess or residual material, usually liquid, from the spout formation 44 back into the container 12 once the container resumes its normal vertical post-pouring position. For this reason, the floor 72 actually acts as a gutter or trough to catch liquid draining from the spout 44 or the inner surface 64 of the wall 28 and to enable that material to flow downward along the floor 72 and through the slot 70 into the container 12. The leveling legs 31 form a tripod with a lower end 73 of the floor 72 to maintain the spout portion 24 in an upright position, thus facilitating manipulation by vertically-oriented automatic handling equipment.

In order to prevent the retention of container contents within the spout portion 24 when the container 12 is inverted in a pouring position, the annular wall 28 is provided with a drainage opening 74 which is in communication with the spout formation 44 and the interior of the container 12. The opening 74 preferably has an upper end 76 which is substantially coextensive with the lower edge of the skirt 37. In this manner, when the container 12 is inverted for pouring, any residual liquid will be able to flow through the opening 74 and out the spout 44. The opening 74 is preferably located opposite the slot 70 on the spout formation 44.

In the preferred embodiment, the interior surface 39 of the skirt 37 is provided with a plurality of ratchet teeth 80. The ratchet teeth 80 are configured to engage the locking formations 22, 22*a* as the spout portion 24 is threaded upon the neck 16 of the container 12. Although in the preferred embodiment the threads 38 of the skirt 37 and the threads 18 of the neck 16 are designed to be of the conventional clockwise or right-hand type, it is also contemplated that these threads may be of the counterclockwise or left-hand type. The shoulder 36 is preferably provided on an underside with at least one annular sealing rib 82 (best seen in FIG. 6) which may be integrally molded with the spout portion 24.

Figure 7:
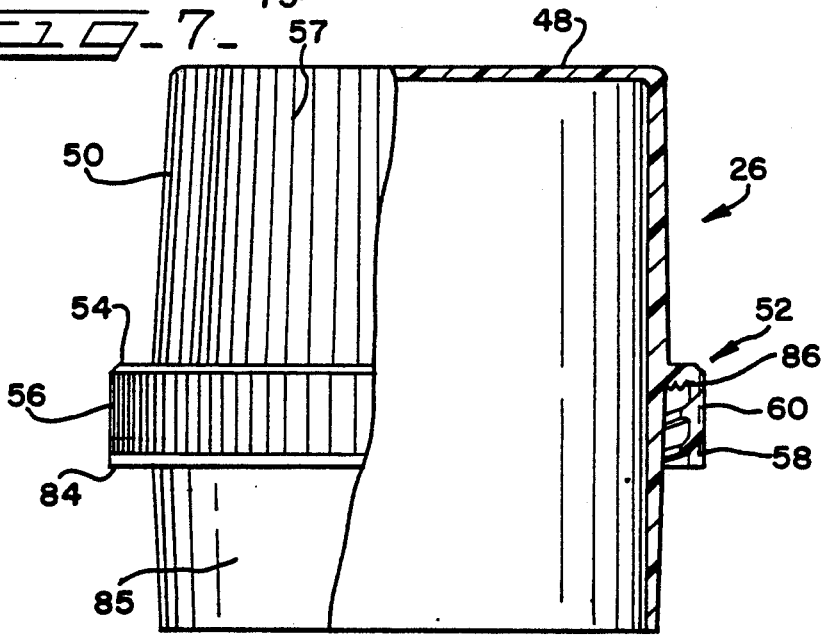
FIG. 7 is a side elevational view of the cap portion shown in FIG. 1, with portions broken away for clarity.

Referring now to FIGS. 1 and 7, it is seen that in the cap portion 26, the tubular wall 50 at its lower end 52 projects vertically downward below a lower edge 84 of the collar 56. The projecting portion 85 is preferably dimensioned to slidingly engage the inner surface 64 of the spout portion 24. Thus, if the cap portion 26 is used as a measuring cup for the contents of the container 12, when the contents are poured from the cap 26, the threads 58 on the collar 56 will not be exposed to the container contents. The external location of the threads 40 on the spout portion 24 also prevents their exposure to container contents. The annular shoulder 54 may be provided on an underside with at least one annular sealing rib 86 (best seen in FIG. 7) which may be integrally molded with the cap portion 26.

To effect assembly, the container 12 is first filled with the specified contents, normally a liquid. Next, the preassembled, integral spout portion 24 is threaded upon the threaded neck 16 of the container 12. In the preferred embodiment, during this threading action, the ratchet teeth 80 engage the locking formations 22 to prevent the subsequent, undesired removal of the spout portion during shipment or use of the container 12. In addition, the sealing ribs 82 engage an upper edge 88 of the neck 16 to prevent the leakage of container contents. Once the spout portion 24 is secured to the container 12, the cap portion 26 is threaded upon the spout portion 24 so that the threads 58 of the collar 56 engage the external threads 40 of the upper end 34 of the annular wall 28. When the cap portion 26 is tightly threaded onto the spout portion 24, the sealing ribs 86 are placed in contacting relationship with an upper edge 90 of the annular wall 28 to prevent the leakage of container contents. The configuration of the present closure 10 allows the cap portion 26 and the spout portion 24 to be preassembled at a remote location and subsequently threaded upon the container in one piece.

In operation, when the container 12 is inverted to pour the contents therefrom, the contents may easily flow through the spout formation 44, as well as through the drainage opening 74. If the cap portion 26 is used as a measuring cup, the extension 85 of the extended lower end 52 prevents the leakage or drippage of the contents into the threads 58 of the collar 56. Thus, the external threads 40 of the surface 42 remain relatively free of container contents.

While a particular embodiment of the dispenser closure of the invention has been shown and described, it will be appreciated by those skilled in the art that changes and modifications may be made thereto without departing from the invention in its broader aspects and as set forth in the following claims.

What is claimed is:

1. A combination dispenser closure and container comprising:

a container having a neck with a threaded exterior surface;

a generally frusto-conically shaped spout portion having an annular wall provided with a lower end, an interior surface, a central part and an upper end, said lower end dimensioned for insertion into said neck, being generally inclined, and being provided with at least one depending leveling leg, said central part having a radially projecting peripheral shoulder with a depending skirt, said skirt being threaded on an interior surface and having a lower edge, said threaded surface configured to threadably engage said threaded neck, said upper end of said annular wall being threaded on an exterior surface, and said should provided with at least one integral annular sealing rib on the underside thereof;

a spout formation being integral with said spout portion and disposed within said interior of said annular wall, said spout formation having a lip projecting above said upper end of said wall, said spout formation being open along a vertical line to form a slot and being located opposite a drainage opening, said drainage opening being integral with said annular wall and located on said wall to be diametrically opposed to said slot, said opening being in communication with said spout formation and the interior of the container and having an upper end which is substantially coextensive with the lower edge of said skirt, so that when the container is inverted for pouring, any residual liquid will flow through said opening and out said spout formation; and a cap portion having a top, a generally tubular wall with a lower end, said lower end being provided with a radially projecting annular shoulder having a depending collar, said collar having a lower edge, said collar being threaded on an interior surface so as to engage said threaded exterior surface of said upper end of said annular wall of said spout portion, said lower end of said tubular wall projecting vertically downward below said lower edge of said collar.

2. A combination dispenser closure and container comprising:

a container having a neck with a threaded exterior surface;

a spout portion having an annular wall provided with a lower end, an interior surface, a central part and an upper end, said lower end dimensioned for insertion into said neck, said lower end of said annular wall being generally inclined and having at least one depending leveling leg, said central part having a radially projecting peripheral shoulder with a depending skirt, said skirt being threaded on an interior surface and having a lower edge, said threaded surface configured to threadably engage said threaded neck, said upper end of said annular wall being threaded on an exterior surface, and said shoulder provided with at least one integral annular sealing rib on the underside thereof;

a spout formation being integral with said spout portion and disposed within said interior of said annular wall, said spout formation having a lip projecting above said upper end of said wall, said spout formation being open along a vertical line to form a slot and being located opposite a drainage opening, said drainage opening being integral with said annular wall and located on said wall to be diametrically opposed to said slot, so that when the container is inverted for pouring, any residual liquid will flow through said opening and out said spout formation; and a cap portion having a top, a generally tubular wall with a lower end, said lower end being provided with a radially projecting annular shoulder having a depending collar, said collar having a lower edge, said collar being threaded on an interior surface so as to engage said threaded exterior surface of said upper end of said annular wall of said spout portion, said lower end of said tubular wall projecting vertically downward below said lower edge of said collar.

3. The combination as defined in claim 2 wherein said drainage opening extends vertically on said annular wall and has an upper end being generally coextensive with a lower edge of said skirt.

4. The combination as defined in claim 2 wherein said spout portion includes a gutter located between a lower margin of said spout formation and said interior surface of said annular wall.

5. The combination as defined in claim 2 wherein said lower end of said tubular wall of said cap portion depends vertically to project when said cap portion is threaded upon said spout portion.

6. The combination as defined in claim 2 wherein said shoulder on said cap portion is provided with at least one margin of said spout information an underside thereof. annular sealing ring on an underside thereof.

7. The combination as defined in claim 2 wherein said threads on said neck and said threads on said skirt are left-handed.

8. The combination as defined in claim 2 wherein said container neck is provided with at least one locking formation.

9. The combination as defined in claim 8 wherein said threaded interior surface of said skirt further includes a plurality of ratchet teeth for ratcheting engagement with said locking formation.

10. A dispenser closure for attachment to a threaded neck of a container, comprising:

a generally cylindrical spout portion having an annular wall provided with a lower end, a central part and an upper end, said central part having a radially projecting peripheral shoulder with a depending skirt, said skirt being threaded on an interior surface and having a lower edge, said threaded surface configured to engage the threaded neck of the container, said upper end of said wall being threaded on an exterior surface;

a generally frusto-conically shaped spout formation having a lip and being disposed within an area defined by said annular wall, said spout formation being integral with said spout portion;

a drainage opening adapted for fully draining the container, said opening being integral with said annular wall, being in communication with said spout formation and the container, and having an upper edge which is substantially coextensive with said lower edge of said skirt; and a cap portion having a top, a generally tubular wall with a lower end, said lower end being provided with a radially projecting annular shoulder having a depending collar, said collar having a lower edge, said collar being threaded on an interior surface so as to engage said threaded exterior surface of said upper end of said annular wall of said spout portion, said lower end of said tubular wall projecting vertically downward below said lower edge of said collar.

11. The closure as defined in claim 10 wherein said lower end of said annular wall is generally inclined and is provided with at least one depending leveling leg.

12. The closure as defined in claim 10 wherein said opening is linearly aligned with said lip of said spout formation.

13. The closure as defined in claim 10 wherein said skirt of said spout portion has an inner surface provided with a plurality of ratchet teeth.

14. The closure as defined in claim 10 wherein said annular wall of said cap has an exterior surface provided with a plurality of ribs.

15. The closure as defined in claim 10 wherein said annular should of said cap portion is provided with at least one annular sealing rib on an underside thereof.

16. The closure as defined in claim 10 wherein said peripheral shoulder of said spout portion is provided with at least one annular sealing rib on an underside thereof.

17. The closure as defined in claim 10 wherein said spout formation has a lower edge which is angled, and said spout defines a gutter between said spout and an inner surface of said annular wall.

18. The closure as defined in claim 17 wherein said spout formation is open along one side.

19. The closure as defined in claim 10 wherein said lower end of said tubular wall of said cap portion extends beyond the lower edge of said collar.

20. The closure as defined in claim 19 wherein said extended lower end of said cap portion wall is configured to slidingly engage said interior surface of said annular wall of said spout portion.

* * * * *

UNITED STATES PATENT AND TRADEMARK OFFICE

CERTIFICATE OF CORRECTION

PATENT NO. : 5,058,772

DATED : October 22, 1991

INVENTOR(S) : Moore, et al.

It is certified that error appears in the above-identified patent and that said Letters Patent is hereby corrected as shown below:

Column 2, line 67, "!4"should be --14--.

In the Claims: Column 6, line 29, after "project" insert --into said interior of said annular wall of said spout portion--.

Column 6, line 33-34, after "one" delete "margin of said spout information an underside thereof.".

Signed and Sealed this

Ninth Day of March, 1993

*Attest:*

STEPHEN G. KUNIN

*Attesting Officer*

*Acting Commissioner of Patents and Trademarks*